US011226159B2

(12) United States Patent
Müggenburg

(10) Patent No.: US 11,226,159 B2
(45) Date of Patent: Jan. 18, 2022

(54) HEAT EXCHANGER

(71) Applicant: Borsig GmbH, Berlin (DE)

(72) Inventor: Jan Müggenburg, Hohen Neuendorf (DE)

(73) Assignee: Borsig GmbH, Berlin (DE)

( * ) Notice: Subject to any disclaimer, the term of this patent is extended or adjusted under 35 U.S.C. 154(b) by 835 days.

(21) Appl. No.: 15/297,486

(22) Filed: Oct. 19, 2016

(65) Prior Publication Data

US 2017/0108282 A1 Apr. 20, 2017

(30) Foreign Application Priority Data

Oct. 20, 2015 (DE) ..... 10 2015 013 517.1

(51) Int. Cl.

| | |
|---|---|
| ***F28D 7/10*** | (2006.01) |
| ***F28D 21/00*** | (2006.01) |
| ***F02M 26/26*** | (2016.01) |
| ***F28F 27/02*** | (2006.01) |
| ***F28F 21/04*** | (2006.01) |
| ***F28D 7/16*** | (2006.01) |
| ***F02M 26/32*** | (2016.01) |
| ***F28F 9/02*** | (2006.01) |

(52) U.S. Cl.

CPC ..... *F28D 7/106* (2013.01); *F02M 26/26* (2016.02); *F02M 26/32* (2016.02); *F28D 7/16* (2013.01); *F28D 21/0001* (2013.01); *F28F 9/0229* (2013.01); *F28F 21/04* (2013.01); *F28F 27/02* (2013.01); *F28F 2250/06* (2013.01); *F28F 2265/26* (2013.01)

(58) Field of Classification Search

CPC ..... F28D 7/106; F28D 7/16; F28F 9/0229; F28F 21/04; F28F 27/02

USPC ..... 165/297

See application file for complete search history.

(56) References Cited

U.S. PATENT DOCUMENTS 447,285 A * 3/1891 Alberger ..... F28F 27/02 122/32
1,918,966 A * 7/1933 Harkness ..... F22B 35/007 165/101

(Continued)

FOREIGN PATENT DOCUMENTS

DE 28 46 455 B1 10/1979
DE 85 04 717 U1 5/1985

(Continued)

*Primary Examiner* — Tho V Duong
*Assistant Examiner* — Raheena R Malik
(74) *Attorney, Agent, or Firm* — McGlew and Tuttle, P.C.

(57) ABSTRACT

A heat exchanger includes a plurality of heat transfer tubes (3) and a centrally arranged bypass tube (4), which are held each between a tube plate (5) of a gas inlet chamber (7) and a tube plate (6) of a gas outlet chamber (8) that are connected to a cylindrical jacket. A coolant (11) is introduced into the jacket space (9) enclosing the tubes (3, 4). A control device (16), includes a throttle valve (18) and a drive (19), sets a gas outlet temperature range of the heat exchanger (1). A discharge rate and a discharged quantity of an uncooled process gas stream (14) from the bypass tube is controlled by the throttle valve, at an outlet end (17) of the bypass tube and is adjustable via the control device. The throttle valve is formed of a material resistant to high-temperature corrosion in a temperature range sensitive for high-temperature corrosion.

20 Claims, 2 Drawing Sheets

(56) References Cited

U.S. PATENT DOCUMENTS 3,477,411 A * 11/1969 Gething ..... F22B 9/14 122/135.1
4,993,367 A * 2/1991 Kehrer ..... F28D 7/163 122/7 R
5,452,686 A * 9/1995 Stahl ..... F22B 1/1884 122/135.1
5,852,990 A * 12/1998 Primdahl ..... F15C 1/20 122/20 B
6,148,909 A * 11/2000 Osanai ..... G05D 23/1919 165/263
7,232,000 B2 * 6/2007 Brossard ..... B60K 17/306 180/256
7,412,945 B2 * 8/2008 Jekerle ..... F28D 7/16 122/7 R
2008/0244975 A1 * 10/2008 Johnston ..... B01J 19/249 48/197 FM
2009/0065185 A1 * 3/2009 Jekerle ..... F28D 7/106 165/175
2009/0293654 A1 12/2009 Pintauro
2011/0059335 A1 * 3/2011 Hernblom ..... B32B 15/01 428/653
2012/0305847 A1 * 12/2012 Von Kossak-Glowczewski ..... C10J 3/86 252/372

FOREIGN PATENT DOCUMENTS

DE 39 13 422 A1 10/1990
DE 10 2005 057 674 B4 5/2008
DE 10 2009 048592 A1 4/2011
EP 0 356 648 A1 3/1990
EP 1 498 678 A1 1/2005
EP 2 312 252 A1 4/2011
WO 2011/089140 A1 7/2011
WO WO 2011089140 A1 * 7/2011 ..... C10J 3/86

* cited by examiner

HEAT EXCHANGER

CROSS REFERENCE TO RELATED APPLICATIONS

This application claims the benefit of priority under 35 U.S.C. § 119 of German Application 10 2015 013 517.1 filed Oct. 20, 2015, the entire contents of which are incorporated herein by reference.

FIELD OF THE INVENTION

The present invention pertains to a heat exchanger, which comprises within a cylindrical jacket a plurality of heat transfer tubes and a centrally arranged bypass tube, which are held each between a tube plate of a gas inlet chamber and a tube plate of a gas outlet chamber, wherein the tube plates are connected to a cylindrical jacket, which forms with the tube plates a jacket space, within which the heat transfer tubes and the bypass tube are enclosed and through which a coolant flows.

BACKGROUND OF THE INVENTION

Heat exchangers are used for various chemical and petrochemical processes. Heat transfer tubes are exposed to different gaseous and/or liquid media within the tubes and outside the tubes on the jacket side in such processes.

As a rule, the hot process gas originating from a process is fed in such processes to the heat transfer tubes as well as to the bypass tube. During the hot process gas flow through the heat transfer tubes, the hot process gas releases heat via the respective tube jacket to a coolant, which is located in the jacket space.

Water is usually used as the coolant. The process gas cooled by the heat transfer to the coolant subsequently flows out of the heat exchanger. It is often necessary to maintain the gas outlet temperature of the heat exchanger in a predefined temperature range.

A usual bypass is usually used to set the gas outlet temperature. The gas outlet temperature is influenced at times with a control valve or rotary control valve or a control plug. Such control devices are arranged at the outlet end of the bypass tube. Such control devices are known from DE 28 46 455 B1 or EP 0 356 648 A1.

The process gases in the bypass tube of a heat exchanger have a very high temperature. In most cases, such process gases also flow through the bypass tube at a high speed. A control device arranged at the outlet end of a bypass tube, for example, a control plug or a control valve, is therefore exposed to a very high load due to thermal effects.

EP 1 498 678 A1 discloses a heat exchanger with a bypass tube, which has a closing device as a formed piston—a piston configured as a closing device, which has a double-walled configuration and in which cooling ducts are formed in the double wall of the piston for the flow of a coolant. The coolant is fed to the cooling ducts in the double wall of the piston through a coolant line provided in a rod for actuating the piston.

DE 39 13 422 A1 discloses a tube bundle heat exchanger, which has a centrally arranged partial flow tube, which provides a control valve at the discharge-side end of the gas flow. The control valve has a double-walled configuration and is equipped in its interior space with ducts, through which a coolant can be passed, which is brought up through a valve shaft configured as a hollow shaft.

DE 10 2005 057 674 B4 discloses a waste heat boiler, which comprises a control device, wherein the speed and the quantity of the gas stream being discharged in the bypass tube can be controlled by a plug, which is arranged at the outlet end of a bypass tube and is axially adjustable by means of the control device. The plug is cooled by a cooling medium, which flows through cooling ducts arranged in the plug.

SUMMARY OF THE INVENTION

It proved to be disadvantageous in the prior-art control devices for a bypass tube for influencing the discharge temperature of a heat exchanger that such cooled pistons or control valves are susceptible to the temperature profiles becoming established, to failure of the cooling stream and thermal shock situations, so that leaks develop at such plugs and control valves. Thus, the prior-art control devices are no longer able to sufficiently accomplish the task of influencing the discharge temperature of a heat exchanger by such control devices for a bypass tube, so that the maintenance intervals will become undesirably short or the service life of a heat exchanger will become shorter.

An object of the present invention is to provide a heat exchanger, which provides a reliable control device for controlling a certain process gas temperature, which control device satisfactorily withstands the high-temperature-related loads of a process gas stream without the use of a coolant for the control element and does not have such a complicated configuration.

The basic object of the present invention is accomplished by providing a heat exchanger, which has the following advantages:

The heat exchanger comprises a plurality of heat transfer tubes and a centrally arranged bypass tube, which are arranged each between a tube plate of a gas inlet chamber and a tube plate of a gas outlet chamber. The respective tube plates are connected to a cylindrical jacket, within which a jacket space is formed. The heat transfer tubes and the bypass tube are enclosed in the jacket space. A coolant flows through the jacket space. An inlet pipe is connected to the cylindrical jacket for introducing a coolant to the jacket side of the heat transfer tubes. Furthermore, an outlet pipe is connected to the cylindrical jacket for draining off water/vapor mixture generated through indirect heat transfer via the jacket side of the heat transfer tubes. An inlet pipe is arranged laterally or axially at the gas inlet chamber in the gas flow direction in front of the tube plate for introducing a hot process gas stream, into the heat transfer tubes and into the bypass tube on the gas inlet side of the tube plate. An outlet pipe is arranged laterally or axially at the gas outlet chamber in the gas flow direction behind the tube plate for draining off a mixture of cooled process gas stream from the heat transfer tubes and uncooled process gas stream from the bypass tube on the gas outlet side of the tube plate. A control device, which is arranged in the immediate vicinity at the outlet end of the bypass tube and which comprises a throttle valve connected to a drive for setting a gas outlet temperature of the heat exchanger to a certain temperature range. A certain discharge speed (discharge rate) and discharged quantity of the process gas stream from the bypass tube can be controlled by the throttle valve, which is arranged at the outlet end of the bypass tube and is adjustable by means of the drive of the control device.

The throttle valve advantageously consists of a material resistant to high-temperature corrosion in the temperature range sensitive to high-temperature corrosion.

The throttle valve of the control device is advantageously arranged adjustably, by means of the drive, via double joints.

The throttle valve of the control device is preferably connected to the drive via a shaft and the double joints.

The throttle valve is advantageously arranged on both sides with an integrated shaft end or shaft attachment in a bearing formed in a heat insulation applied at the inner wall of the valve housing and the shaft is arranged in a bearing in the wall of the gas outlet chamber, the double joints connected to the drive via the shaft end and the shaft being provided for compensating differences in expansion between the bearing of the respective shaft end of the throttle valve in the valve housing and the bearing of the shaft in the wall of the gas outlet chamber.

The throttle valve comprises a valve body that is arranged rotatably in the valve housing at right angles to the gas flow direction. The valve housing is advantageously configured as an extension of the bypass tube with the same diameter or with an expanded diameter with a conical attachment as a transition from the outlet end of the bypass tube to the expanded diameter.

A ceramic material is preferably used as a high-temperature-resistant or metal-dusting-resistant material for the throttle valve, particularly for the valve body.

Based on the advantageous embodiment of a heat exchanger with a control device for adjusting the gas outlet temperature of a cooled process gas stream to the required temperature conditions in a certain temperature range by means of the uncooled process gas stream from the bypass tube, reliable influencing of the temperature is provided, which operates independently from a satisfactory coolant feed and the efficiency of the cooling for the control elements used and of the sealing of the coolant lines. High-temperature-resistant or metal-dusting-resistant materials, which do not require special cooling, are used for the control element in the present invention. Components made of other materials are arranged such that they are heat insulated from the uncooled process gas stream to the extent that these components can reliably be used according to the suitability of these materials.

An exemplary embodiment of the present invention will be explained in more detail below in the description on the basis of a heat exchanger shown in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
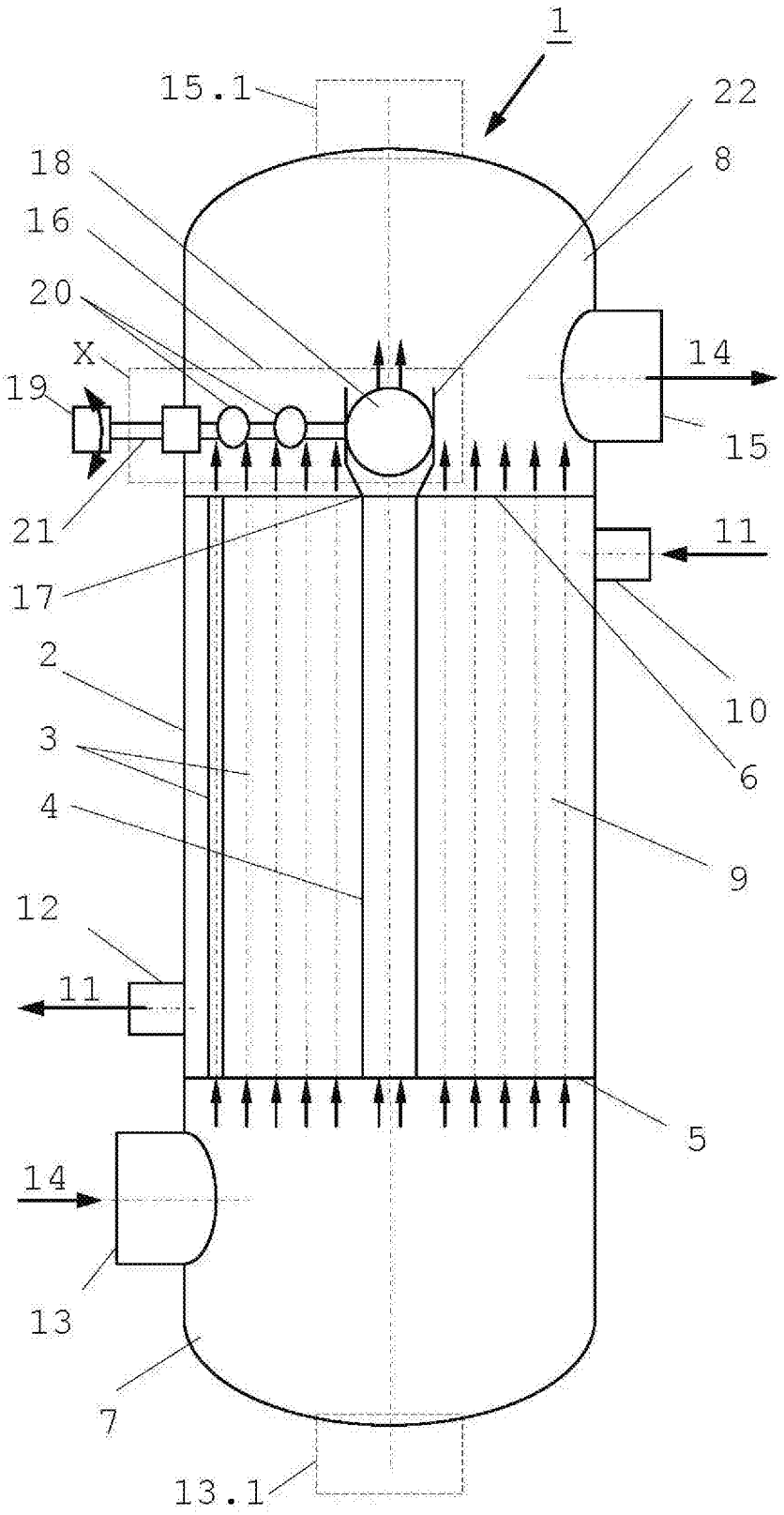
FIG. 1 is a longitudinal sectional view through a heat exchanger, on a reduced scale, according to the present invention.

Referring to the drawings, a heat exchanger 1 is schematically shown in a longitudinal section in FIG. 1 in a vertical arrangement. Such heat exchangers 1 are used for various chemical and petrochemical processes. The heat exchanger 1 comprises a plurality of heat transfer tubes 3 and a centrally arranged bypass tube 4, which are held each between a tube plate 5 of a gas inlet chamber 7 and a tube plate 6 of a gas outlet chamber 8. The respective tube plates 5, 6 are connected to a cylindrical jacket 2, within which a jacket space 9 is formed. The heat transfer tubes 3 and the bypass tube 4 are enclosed in the jacket space 9. A coolant 11 flows through the jacket space 9.

The bypass tube 4 is configured with a larger diameter than the heat transfer tubes 3. Over a length of the bypass tube 4, the bypass tube 4 has heat insulation 23, on an inner tube wall 30. The heat insulation 23 is intended and configured for the bypass tube 4 not releasing essentially any heat while the process gas stream 14 is flowing through.

As is indicated by an arrow, the coolant 11 flows into the jacket space 9 via at least one inlet pipe 10 arranged laterally at the cylindrical jacket 2 in the flow direction of the process gas stream 14 in front of the tube plate 6 of the gas outlet chamber 8. The coolant 11 leaves the jacket space 9 as a water/vapor mixture via at least one outlet pipe 12 arranged laterally on the cylindrical jacket 2 behind the tube plate 5 of the gas inlet chamber 7. The water/vapor mixture formed during the cooling is generated by indirect heat transfer via the jacket side of the heat transfer tubes 3.

An inlet pipe 13, 13.1 is arranged in front of the tube plate 5 in the gas flow direction at the gas inlet chamber 7 laterally (13) or axially (13.1—as is indicated by dotted line only). As is indicated by an arrow, the process gas stream 14 flows through the inlet pipes 13, 13.1 into the gas inlet chamber 7 and from there into the ends of the heat transfer tubes 3 held in the tube plate 5 and into the end of the bypass tube 4, as is indicated by arrows.

Indicated by dotted line only, a discharge pipe 15, 15.1 is arranged at the gas outlet chamber 8 laterally (15) or axially (15.1) behind the tube plate 6 in the gas flow direction. As is indicated by an arrow, the process gas stream 14 leaves the gas outlet chamber 8, which is connected to the ends of the heat transfer tubes 3 being held in the tube plate 6 and to the other end of the bypass tube 4, from which split process gas streams escape, as is indicated by arrows, through said discharge pipes 15, 15.1.

A control device 16 is arranged at the outlet end 17 of the bypass tube 4. The control device 16 comprises a throttle valve (valve body) 18 in a valve housing 22 and a drive 19 arranged outside the heat exchanger 1. The drive 19 is connected to a shaft 21 and double joints 20 and to an integrated shaft end 27 of the throttle valve 18 and forms a powertrain. The throttle valve 18 is arranged adjustably with the connected double joints 20 and with the shaft end 27 by means of the drive 19 via the shaft 21.

The double joints are intended essentially for compensating differences in thermal expansion between two bearings 25 for the respective integrated shaft end 27 of the throttle valve 18 in the valve housing 22 and a bearing 26 for the shaft 21. The respective bearing 26 is formed in a heat insulation 24, which is applied to an inner wall 29 of the valve housing 22. The bearing 26 is arranged in a wall 28 of the gas outlet chamber 8.

The throttle valve (body) 18 is arranged rotatably at right angles to the gas flow direction in the valve housing 22. The heat insulation 24 applied to the inner wall 29 of the valve housing 22 is preferably configured as a lining.

Figure 2:
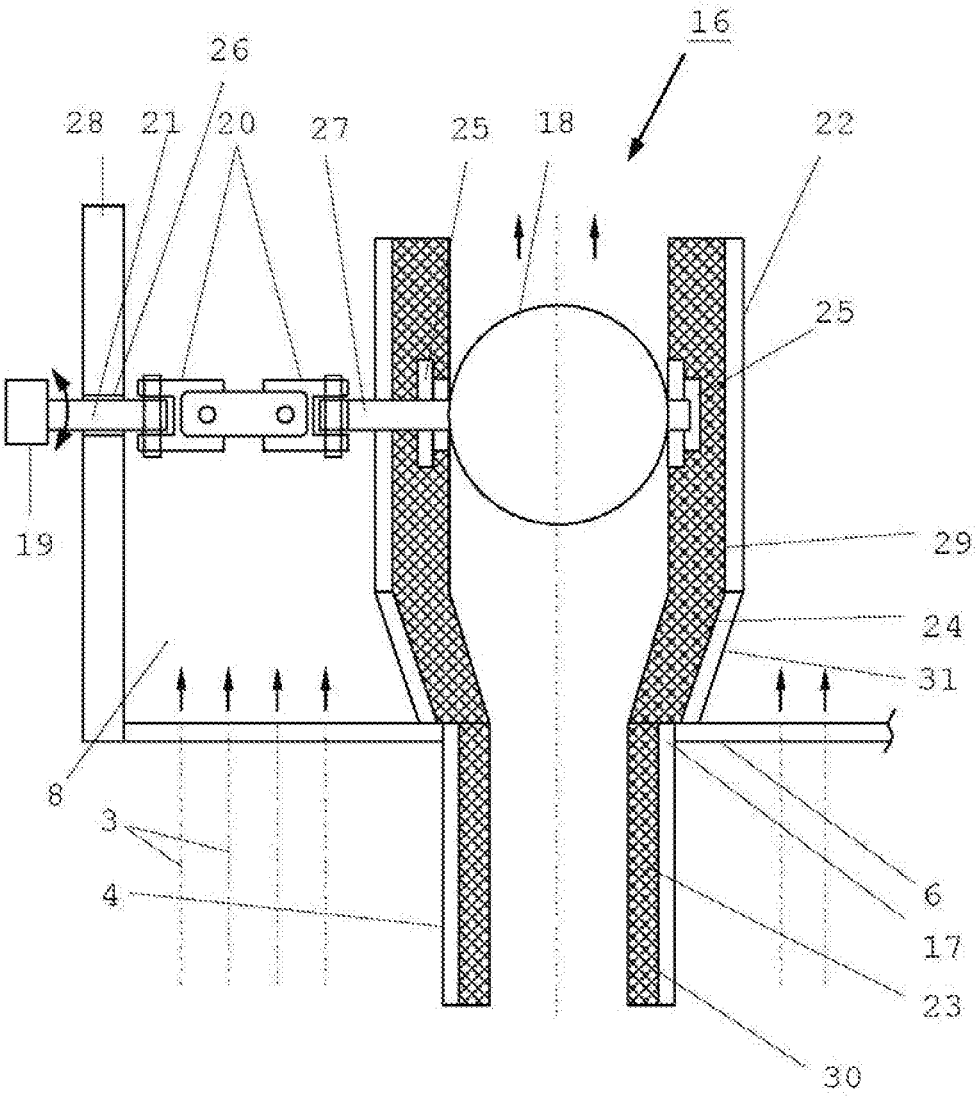
FIG. 2 is a detail X of FIG. 1 as a longitudinal sectional view on an enlarged scale through an outlet end of a bypass tube of a heat exchanger according to the present invention with a control device arranged in the area of the outlet end.

The valve housing 22 is configured as an extension of the bypass tube 4 with equal diameter if the existing installation conditions at the heat exchanger 1 are sufficient. In case of crowded installation conditions, a configuration of the valve housing 22 as is shown in FIG. 2 is to be preferred, and the extension of the bypass tube 4 over a conical attachment 31 is configured as a transition from the outlet end 17 of the bypass tube to an expanded diameter.

The throttle valve 18 connected to the drive 19 is provided for setting a gas outlet temperature of the heat exchanger 1 to a certain temperature range by mixing the cooled process gas stream 14 from the heat transfer tubes 3 with the uncooled process gas stream from the bypass tube 4. A discharge speed (discharge rate) and a discharged quantity of the process gas stream 14 can be controlled with the throttle valve 18, which is arranged in the immediate vicinity of the outlet end 17 of the bypass tube 4 and adjustable by means of the drive 19 of the control device 16.

The throttle valve 18 is made of a material resistant to high-temperature corrosion in the temperature range sensitive to high-temperature corrosion, which ranges from temperatures around 500° C. to an order of magnitude of about 850° C. The materials used as the control element for the throttle valve 18 are high-temperature-resistant or metal-dusting-resistant materials that have temperature stability and do not require special cooling. The valve housing 22 is manufactured from a material that is not necessarily fully resistant to high temperature corrosion, but is operated at a temperature outside of the range of high temperature corrosion. The valve housing 22 is protected by the insulation against high temperatures A ceramic material, which has high-temperature-resistant or metal-dusting-resistant properties with temperature stability, is used as a material for the throttle valve 18—particularly, the throttle valve body—is comprised of ceramic material or especially consists of a ceramic material.

Components made of other materials are arranged heat insulated from the uncooled process gas stream 14 to the extent that these components can be used reliably according to the suitability of these materials.

While specific embodiments of the invention have been shown and described in detail to illustrate the application of the principles of the invention, it will be understood that the invention may be embodied otherwise without departing from such principles.

What is claimed is:

1. A heat exchanger comprising:

a cylindrical jacket;

a plurality of heat transfer tubes;

a centrally arranged bypass tube;

a gas inlet chamber tube plate cooperating with the cylindrical jacket to form a gas inlet chamber;

a gas outlet chamber tube plate cooperating with the cylindrical jacket to form a gas outlet chamber, the bypass tube and the heat transfer tubes being held between the gas inlet chamber tube plate and the gas outlet chamber tube plate, wherein the gas inlet chamber tube plate and the gas outlet chamber tube plate are connected to the cylindrical jacket to form a jacket space therewithin, whereby the heat transfer tubes and the bypass tube are enclosed and a coolant can be introduced into the jacket space;

at least one inlet pipe connected to the cylindrical jacket for introducing a coolant into the jacket space to a jacket side of the heat transfer tubes;

at least one outlet pipe connected to the cylindrical jacket for draining off a water/vapor mixture from the jacket space, which is produced by indirect heat transfer via the jacket side of the heat transfer tubes;

an inlet pipe arranged laterally or axially at the gas inlet chamber in front of the tube plate in a gas flow direction for introducing a hot process gas stream into the heat transfer tubes and into the bypass tube on a gas inlet side of inlet chamber tube plate;

a discharge pipe arranged laterally or axially at the gas outlet chamber behind the tube plate in the gas flow direction for draining off a mixture of the cooled process gas streams from the heat transfer tubes and from the uncooled process gas stream from the bypass tube on the gas outlet side of the outlet chamber tube plate; and a control device comprising a drive and a throttle valve connected to the drive for setting a gas outlet temperature of the heat exchanger to a certain temperature range by mixing the cooled process gas streams from the heat transfer tubes with the uncooled process gas stream from the bypass tube, the throttle valve being arranged at an outlet end of the bypass tube, the throttle valve being arranged in a valve housing, the drive being arranged outside the heat exchanger, wherein a discharge rate and a discharged quantity of the uncooled process gas stream from the bypass tube is controlled by the throttle valve and is adjustable via the drive of the control device, wherein the throttle valve is manufactured from a material resistant to high-temperature corrosion in a temperature range sensitive to high-temperature corrosion and wherein the valve housing is manufactured from a material not necessarily fully resistant to high temperature corrosion, but operated at a temperature outside of the range of high temperature corrosion and wherein the valve housing is protected by an insulation against high temperatures, the temperature range being around 500° C. to about 850° C., the material resistant to high-temperature corrosion comprising a ceramic material.

2. A heat exchanger in accordance with claim 1, wherein the control device further comprises double joints adjustably connecting the throttle valve of the control device to the drive.

3. A heat exchanger in accordance with claim 2, wherein the control device further comprises a shaft, the shaft and the double joints connecting the throttle valve of the control device to the drive.

4. A heat exchanger in accordance with claim 1, wherein the control device further comprises double joints and a shaft and the shaft and the double joints connect the throttle valve of the control device to the drive.

5. A heat exchanger in accordance with claim 2, wherein:

heat insulation is applied on valve housing inner walls of the valve housing and a bearing at two wall sides is formed in the heat insulation applied on the inner walls;

a bearing is provided in a wall of the gas outlet chamber;

the throttle valve has an integrated shaft supported by the bearing at two wall sides and with a shaft end;

a shaft is arranged in the bearing in the wall of the gas outlet chamber; and the double joints are connect to the drive via the shaft end and the shaft for compensating differences in expansion between the respective bearing of the shaft end of the throttle valve in the valve housing and the bearing of the shaft arranged in the wall of the gas outlet chamber.

6. A heat exchanger in accordance with claim 3, wherein:

the heat insulation is applied on valve housing inner walls of the valve housing and valve bearings at two wall sides are formed in the heat insulation applied on the inner walls;

the throttle valve has a shaft arrangement with a shaft end portion in one of the valve bearings and another shaft end portion in another of the valve bearings;

a chamber wall bearing is provided in a wall of the gas outlet chamber;

the shaft is arranged in the chamber wall; and the shaft connects the double joints to the drive and the shaft end portion connects the double joints to the throttle valve whereby the double joints compensate for thermal expansion differences between one or more of the valve bearings and the chamber wall bearing.

7. A heat exchanger in accordance with claim 1, wherein the throttle valve comprises a valve body arranged rotatably in the valve housing and acting at right angles to the gas flow direction, wherein the valve body is rotatable relative to the valve housing.

8. A heat exchanger in accordance with claim 5, wherein the throttle valve comprises a valve body arranged rotatably in the valve housing and acting at right angles to the gas flow direction, wherein the valve body is rotatable relative to the valve housing about an axis perpendicular to the gas flow direction.

9. A heat exchanger in accordance with claim 6, wherein the throttle valve comprises a valve body arranged rotatably in the valve housing and acting at right angles to the gas flow direction, wherein actuation of the drive rotates the throttle valve, relative to the valve housing, to adjust a flow rate of the uncooled process gas stream exiting the bypass tube.

10. A heat exchanger in accordance with claim 1, wherein the valve housing is configured as an extension of the bypass tube, the valve housing having:

essentially a same diameter as the bypass tube; or an expanded diameter with a conical attachment as a transition from an outlet end of the bypass tube to the expanded diameter.

11. A heat exchanger in accordance with claim 1, wherein the ceramic defines a metal-dusting-resistant or high-temperature-resistant material.

12. A heat exchanger comprising:

a cylindrical jacket;

a plurality of heat transfer tubes;

a centrally arranged bypass tube;

a gas inlet chamber tube plate cooperating with the cylindrical jacket to form a gas inlet chamber;

a gas outlet chamber tube plate cooperating with the cylindrical jacket to form a gas outlet chamber, the bypass tube and the heat transfer tubes being held between the gas inlet chamber tube plate and the gas outlet chamber tube plate, wherein the gas inlet chamber tube plate and the gas outlet chamber tube plate are connected to the cylindrical jacket to form a jacket space, whereby the heat transfer tubes and the bypass tube are enclosed and a coolant can be introduced into the a jacket space;

at least one inlet pipe connected to the cylindrical jacket for introducing a coolant into the jacket space to a jacket side of the heat transfer tubes;

at least one outlet pipe connected to the cylindrical jacket for draining off a water/vapor mixture from the jacket space, which is produced by indirect heat transfer via the jacket side of the heat transfer tubes;

an inlet pipe connected to the gas inlet chamber for introducing a hot process gas stream into the heat transfer tubes and into the bypass tube on a gas inlet side of inlet chamber tube plate;

a discharge pipe connected to the gas outlet chamber for removing a mixture of the cooled process gas streams from the heat transfer tubes and from the uncooled process gas stream from the bypass tube on the gas outlet side of the outlet chamber tube plate; and a control device comprising a drive and a throttle valve connected to the drive for setting a gas outlet temperature of the heat exchanger to a certain temperature range by mixing the cooled process gas streams from the heat transfer tubes with the uncooled process gas stream from the bypass tube, the throttle valve being arranged at the outlet end of the bypass tube, the throttle valve being arranged in a valve housing, the drive being arranged outside the heat exchanger, wherein a discharge rate and a discharged quantity of the uncooled process gas stream from the bypass tube is controlled by the throttle valve and is adjustable via the drive of the control device, wherein the throttle valve comprises a valve body formed of a high-temperature corrosion range corrosion resistant material, the temperature range being around 500° C. to about 850° C., the high-temperature corrosion range corrosion resistant material comprising a ceramic material.

13. A heat exchanger in accordance with claim 12, wherein the control device further comprises double joints and a shaft and the shaft and the double joints connect the throttle valve of the control device to the drive.

14. A heat exchanger in accordance with claim 13, wherein:

heat insulation is applied on valve housing inner walls and valve bearings at two wall sides are formed in the heat insulation applied on the inner walls;

the throttle valve has a shaft arrangement with a shaft end portion in one of the valve bearings and another shaft end portion in another of the valve bearings;

a chamber wall bearing is provided in a wall of the gas outlet chamber;

the shaft is arranged in the chamber wall; and the shaft connects the double joints to the drive and the shaft end portion connects the double joints to the throttle valve whereby the double joints compensate for thermal expansion differences between one or more of the valve bearings and the chamber wall bearing.

15. A heat exchanger in accordance with claim 14, wherein the valve body is arranged rotatably in the valve housing and acts at right angles to the gas flow direction.

16. A heat exchanger in accordance with claim 15, wherein the valve housing is configured as an extension of the bypass tube, the valve housing having:

essentially a same diameter as the bypass tube; or an expanded diameter with a conical attachment as a transition from an outlet end of the bypass tube to the expanded diameter.

17. A heat exchanger in accordance with claim 12, wherein the corrosion resistance of the material includes metal-dusting-resistance.

18. A heat exchanger in accordance with claim 12, wherein the throttle valve comprises a valve body, the valve body being rotatable relative to the valve housing.

19. A heat exchanger in accordance with claim 12, wherein actuation of the drive rotates the throttle valve to adjust a flow rate of the uncooled process gas stream exiting the bypass tube.

20. A heat exchanger comprising:

a cylindrical jacket;

a plurality of heat transfer tubes;

a centrally arranged bypass tube;

a gas inlet chamber tube plate cooperating with the cylindrical jacket to form a gas inlet chamber;

a gas outlet chamber tube plate cooperating with the cylindrical jacket to form a gas outlet chamber, the bypass tube and the heat transfer tubes being held between the gas inlet chamber tube plate and the gas outlet chamber tube plate, wherein the gas inlet chamber tube plate and the gas outlet chamber tube plate are connected to the cylindrical jacket to form a jacket space, whereby the heat transfer tubes and the bypass tube are enclosed and a coolant can be introduced into the a jacket space;

at least one inlet pipe connected to the cylindrical jacket for introducing a coolant into the jacket space to a jacket side of the heat transfer tubes;

at least one outlet pipe connected to the cylindrical jacket for draining off a water/vapor mixture from the jacket space, which is produced by indirect heat transfer via the jacket side of the heat transfer tubes;

an inlet pipe connected to the gas inlet chamber for introducing a hot process gas stream into the heat transfer tubes and into the bypass tube on a gas inlet side of inlet chamber tube plate;

a discharge pipe connected to the gas outlet chamber for removing a mixture of the cooled process gas streams from the heat transfer tubes and from the uncooled process gas stream from the bypass tube on the gas outlet side of the outlet chamber tube plate; and a control device comprising a drive and a throttle valve connected to the drive for setting a gas outlet temperature of the heat exchanger to a certain temperature range by mixing the cooled process gas streams from the heat transfer tubes with the uncooled process gas stream from the bypass tube, the throttle valve being arranged at the outlet end of the bypass tube, the throttle valve being arranged in a valve housing, the drive being arranged outside the heat exchanger, wherein a discharge rate and a discharged quantity of the uncooled process gas stream from the bypass tube is controlled by the throttle valve and is adjustable via the drive of the control device, wherein the throttle valve comprises a valve body, the valve body comprising a ceramic material, the ceramic material being corrosion resistant in a temperature range of 500° C. to about 850° C.

* * * * *